US007169230B2

(12) United States Patent
Ghelli et al.

(10) Patent No.: US 7,169,230 B2
(45) Date of Patent: Jan. 30, 2007

(54) COATER APPARATUS

(75) Inventors: Luca Ghelli, Turin (IT); Corrado Turinetti, Luigi (IT); Giorgio Baldins, San Pietro (IT)

(73) Assignee: PHT Italia S.p.A., Pinerolo (IT)

( * ) Notice: Subject to any disclaimer, the term of this patent is extended or adjusted under 35 U.S.C. 154(b) by 0 days.

(21) Appl. No.: 10/503,883

(22) PCT Filed: Jan. 24, 2003

(86) PCT No.: PCT/IB03/00549

§ 371 (c)(1),
(2), (4) Date: Jul. 27, 2004

(87) PCT Pub. No.: WO03/064057

PCT Pub. Date: Aug. 7, 2003

(65) Prior Publication Data

US 2005/0172890 A1 Aug. 11, 2005

(30) Foreign Application Priority Data

Jan. 28, 2002 (IT) ..... RM2002A0043

(51) Int. Cl.
*B05C 5/02* (2006.01)
*B05D 1/26* (2006.01)

(52) U.S. Cl. ..... 118/410; 118/413; 118/419; 427/356

(58) Field of Classification Search ..... 118/413, 118/410, 419; 427/356; 425/466
See application file for complete search history.

(56) References Cited

U.S. PATENT DOCUMENTS 4,512,279 A * 4/1985 Damrau et al. ..... 118/411
4,513,915 A * 4/1985 Kohler et al. ..... 239/455
4,697,542 A * 10/1987 Kohler et al. ..... 118/63
5,820,675 A * 10/1998 Madrzak ..... 118/410

* cited by examiner

*Primary Examiner*—Laura Edwards
(74) *Attorney, Agent, or Firm*—David J. Archer

(57) ABSTRACT

A coater apparatus (10) is disclosed for applying coating material onto a moving web. The apparatus (10) includes an applicator having a first and a second end, the applicator (16) defining a feeding chamber (22) for the reception therein of the coating material (12). The applicator (16) includes a fixed lip (24) which extends from the feeding chamber (22) towards the web (14). A movable lip (26) extends from the feeding chamber (22) such that when the movable lip (26) is disposed in a first disposition thereof, the movable lip (26) cooperates with the fixed lip (24) for defining therebetween a slot for guiding the coating material (12) from the feeding chamber (22) towards the moving web (14). However, when the movable lip (26) is pivoted away from the fixed lip (24) to a second and third disposition thereof, flushing and cleaning of the applicator (16) is permitted.

14 Claims, 7 Drawing Sheets

COATER APPARATUS

The present invention relates to a coater apparatus for applying coating material onto a moving web. More specifically, the present invention relates to a coater apparatus which permits opening of the apparatus for flushing and cleaning thereof

BACKGROUND INFORMATION

Fountain applicators are used for applying coating material to a web of paper for enhancing the printability of the paper.

Typically, the fountain coater or applicator applies a thin layer of liquid coating material on a moving web forcing the liquid through a slot to form a jet that is distributed on the web. To secure a uniform distribution of the liquid coating material on the web which may be 40 foot in width, it is necessary that the jet be uniform and smooth. Therefore, any mechanical parts disposed within the slot might accumulate impurities contained in the coating material thus causing an obstruction of the liquid flow subsequently damaging the uniformity of the applied layer.

The present invention provides a unique structure which permits opening the fountain applicator slot along the entire width of the slot for flushing and cleaning purposes. The unique structure utilizes a mechanical device which is disposed external relative to the distribution slot, thereby maintaining the continuity and straightness of the internal wall and slot just as is the case in the prior art type fountain applicators having fixed slots.

More particularly, the applicator according to the present invention permits opening of the thin slot for cleaning purposes both during its operation and during scheduled stops for maintenance and cleaning.

The applicator according to the present invention utilizes mechanical opening and dosing stops extending continuously along the width of the coater and disposed externally to the slot or liquid flow channel.

The system according to the present invention avoids the accumulation of dirt that could obstruct the regular flow of coating material. Also, the arrangement of the present invention maintains a repeatability of all set up working positions so that such positions are guaranteed along the entire width of the slot. Accordingly, the coater apparatus of the present invention requires little maintenance due to the simplicity of the system.

Therefore, it is a feature of the present invention to provide a coater apparatus that overcomes the problems associated with the prior art arrangements and which makes a considerable contribution to the art of manufacturing such a coater apparatus.

Another feature of the present invention is the provision of a coater apparatus which enables cleaning and flushing of the coater apparatus.

A further feature of the present invention is the provision of a coater apparatus which is simple in construction.

Another feature of the present invention is the provision of a coater apparatus which avoids the accumulation of dirt that would otherwise obstruct flow of coating material.

A further feature of the present invention is the provision of a coater apparatus which enables repeatability of all set up working positions.

Also, another feature of the present invention is the provision of a coater apparatus which maintains the continuity and straightness of the internal wall and slot.

Other features and advantages of the coating apparatus according to the present invention will be readily apparent to those skilled in the art by a consideration of the detailed description of a preferred embodiment of the invention contained herein.

SUMMARY OF THE INVENTION

In one aspect, the invention provides a coater apparatus for applying coating material onto a moving web, said apparatus comprising: an applicator having a front and a back side, said applicator defining a feeding chamber for the reception therein of the coating material; said applicator including a fixed lip extending from said feeding chamber towards the web; and a movable lip extending from said feeding chamber such that when said movable lip is disposed in a first disposition thereof, said movable lip cooperates with said fixed lip for defining therebetween a slot for guiding the coating material from said feeding chamber towards the moving web and when said movable lip is pivoted away from said fixed lip to a second disposition thereof, flushing of said applicator is permitted and when said movable lip is further pivoted away from said fixed lip to a third disposition thereof, cleaning and maintenance of said applicator is permitted.

In another aspect, the invention provides a coater apparatus for applying coating material onto a moving web, said apparatus comprising: an applicator having a front and a backside, said applicator defining a feeding chamber for the reception therein of the coating material; said applicator including: a fixed lip extending from said feeding chamber towards the web; a movable lip extending from said feeding chamber such that when said movable lip is disposed in a first disposition thereof, said movable lip cooperates with said fixed lip for defining therebetween a slot for guiding the coating material from said feeding chamber towards the moving web and when said movable lip is pivoted away from said fixed lip to a second disposition thereof, flushing of said applicator is permitted; and a mechanism for controlling movement of said movable lip relative to said fixed lip.

In a further aspect, the invention provides a coater apparatus for applying coating material onto a moving web, said apparatus comprising an applicator having a first and a second end, said applicator defining a feeding chamber for the reception therein of the coating material; said applicator including: a fixed lip extending from said feeding chamber towards the web; a movable lip extending from said feeding chamber such that when said movable lip is disposed in a first disposition thereof, said movable lip cooperates with said fixed lip for defining therebetween a slot for guiding the coating material from said feeding chamber towards the moving web and when said movable lip is pivoted away from said fixed lip to a second disposition thereof, flushing of said applicator is permitted and when said movable lip is further pivoted away from said fixed lip to a third disposition thereof, cleaning and maintenance of said applicator is permitted; said applicator extending across the width of the web and being pivotally mounted relative to the web; said feeding chamber being connected to a pressurized source of the coating material; said fixed lip defining a smooth wall which extends from said feeding chamber towards the web; said movable lip having a first and a second end, said first end of said movable lip defining a knuckle; a section having a first and a second extremity, said section extending between said first and second ends of said applicator such that said movable lip is disposed between said slot and said section; said section being removably secured to said applicator, said section defining a socket for the rotatable reception therein of said knuckle of said movable lip for permitting pivoting of said movable lip away from said fixed lip; a mechanism disposed adjacent to said section for controlling movement of said movable lip relative to said fixed lip; said mechanism including: an inflatable tube which extends between said first and second extremities of said section, said inflatable tube being disposed between said section and said movable lip, said mechanism further including: an elongate member secured to said movable lip; a further inflatable tube disposed between said elongate member and said section such that when said inflatable tube is deflated and said further inflatable tube is inflated, said elongate member and said movable lip secured thereto is urged by said further inflatable tube away from said section so that said movable lip pivots away from said fixed lip to said second or third disposition thereof and when said further inflatable tube is deflated and said inflatable tube is inflated, said movable lip is pivoted from said second or third disposition to said first disposition thereof, said section including: a stop for limiting pivotal movement of said movable lip away from said fixed lip; and said stop extending between said extremities of said section.

In a more specific embodiment of the present invention, the applicator extends across the width of the web and is pivotally mounted relative to the web.

Furthermore, the feeding chamber is connected to a pressurized source of the coating material and the feeding chamber is of pear shaped cross-sectional configuration.

Additionally, the fixed lip defines a smooth wall which extends from the feeding chamber towards the web.

The movable lip has a first and a second end, the first end of the movable lip defining a knuckle.

Moreover, the coater apparatus further includes a section having a first and a second extremity. The section extends between the first and second ends of the applicator such that the movable lip is disposed between the slot and the section.

More particularly, the section is removably secured to the applicator, the section defining a socket for the rotatable reception therein of the knuckle of the movable lip for permitting pivoting of the movable lip away from the fixed lip.

A mechanism is disposed adjacent to the section for controlling movement of the movable lip relative to the fixed lip.

More specifically, the mechanism includes an inflatable tube which extends between the first and second extremities of the section, the inflatable tube being disposed between the section and the movable lip.

Also, the mechanism further includes an elongate member which is secured to the movable lip. A further inflatable tube is disposed between the elongate member and the section such that when the inflatable tube is deflated and the further inflatable tube is inflated, the elongate member and the movable lip secured thereto is urged by the further inflatable tube away from the fixed lip. The arrangement is such that the movable lip pivots away from the fixed lip to the second or third disposition thereof However, when the further inflatable tube is deflated and the inflatable tube is inflated, the movable lip is pivoted from the second or third disposition towards the fixed lip to the first disposition thereof.

Additionally, the section includes stops for limiting pivotal movement of the movable lip away from the fixed lip for achieving a maximum open position for maintenance and cleaning.

Also, rotatable pins with an eccentric seat are located on the front and back sides of the fountain applicator for adjusting how far the movable lip pivots away from the fixed lip in order to control the thickness of the slot suitable for the correct flushing.

Furthermore, the coater apparatus further includes a first and a second edge seal, the first seal cooperating with the front of the applicator for sealing the feeding chamber and the slot. The second seal cooperates with the backside of the applicator for sealing the feeding chamber and the slot. The seals are movable away from the feeding chamber and slot during a flushing operation and are removed during a cleaning operation of the apparatus.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the present invention.

DETAILED DESCRIPTION OF THE DRAWINGS

Figure 1:
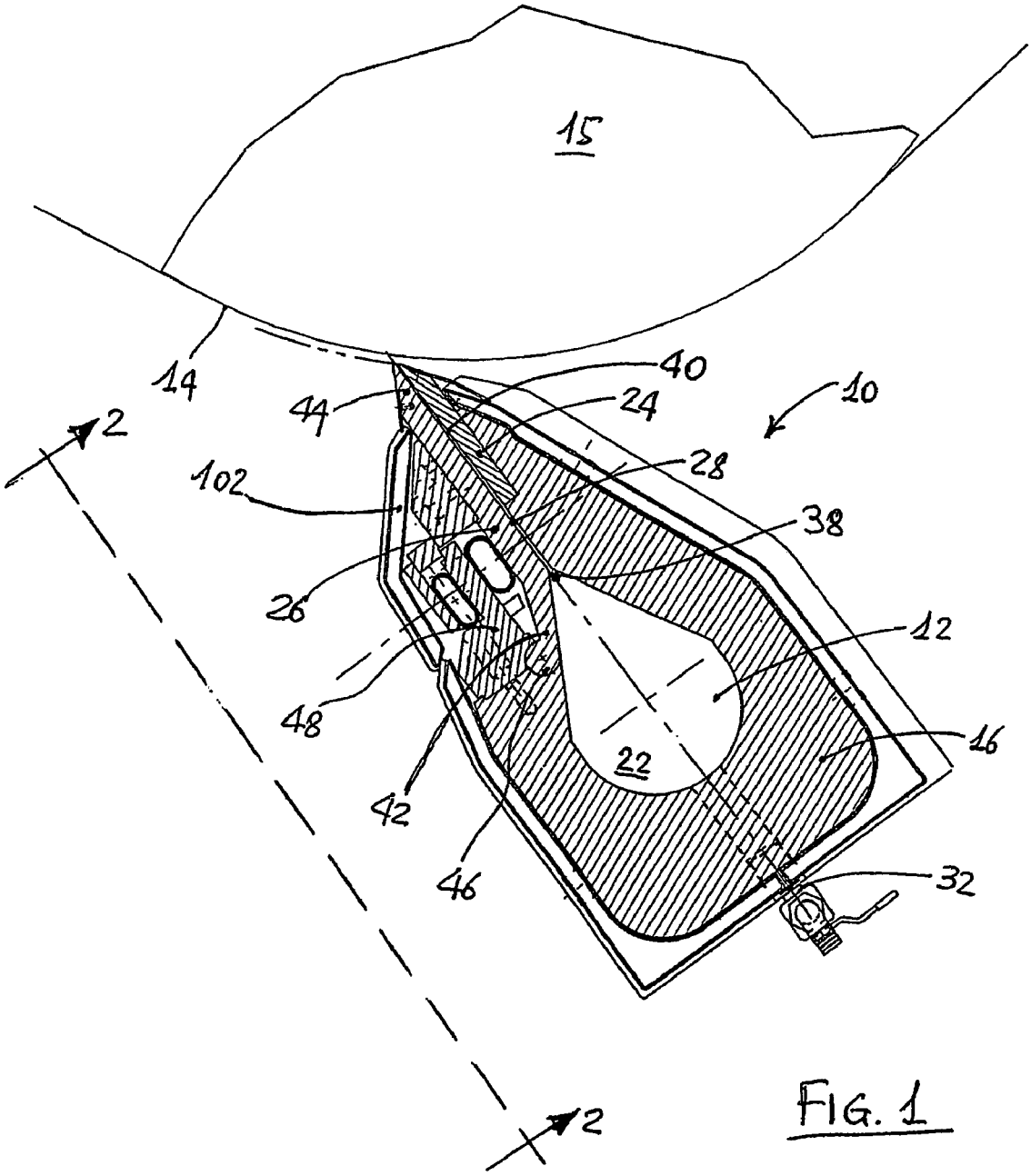
FIG. 1 is cross sectional view of a coater apparatus according to the present invention.

FIG. 1 is cross sectional view of a coater apparatus generally designated 10 according to the present invention for applying coating material 12 onto a moving web 14 supported by a backing roll 15. As shown in FIG. 1, the apparatus 10 includes an applicator generally designated 16.

Figure 2:
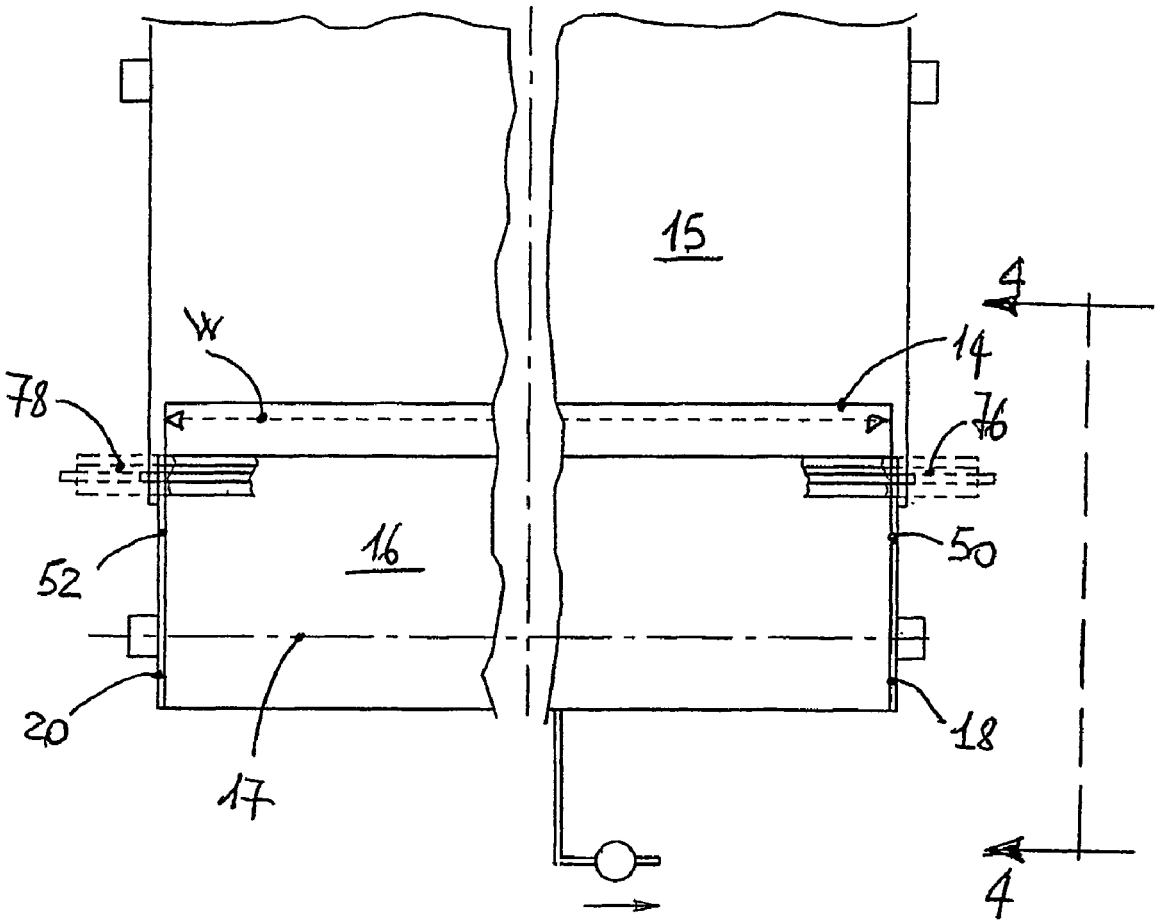
FIG. 2 is a view taken on the line 2—2 of FIG. 1.

FIG. 2 is a view taken on the line 2—2 of FIG. 1. As shown in FIG. 2, the applicator 16 has a front and backside 18 and 20 respectively.

As shown in FIG. 1, the applicator 16 defines a feeding chamber 22 for the reception therein of the coating material 12. The applicator 16 includes a fixed lip 24 which extends from the feeding chamber 22 towards the web 14. A movable lip 26 extends from the feeding chamber 22 such that when the movable lip 26 is disposed in a first disposition thereof as shown in FIG. 1, the movable lip 26 cooperates with the fixed lip 24 for defining therebetween a slot 28 for guiding the coating material 12 from the feeding chamber 22 towards the moving web 14.

Figure 3:
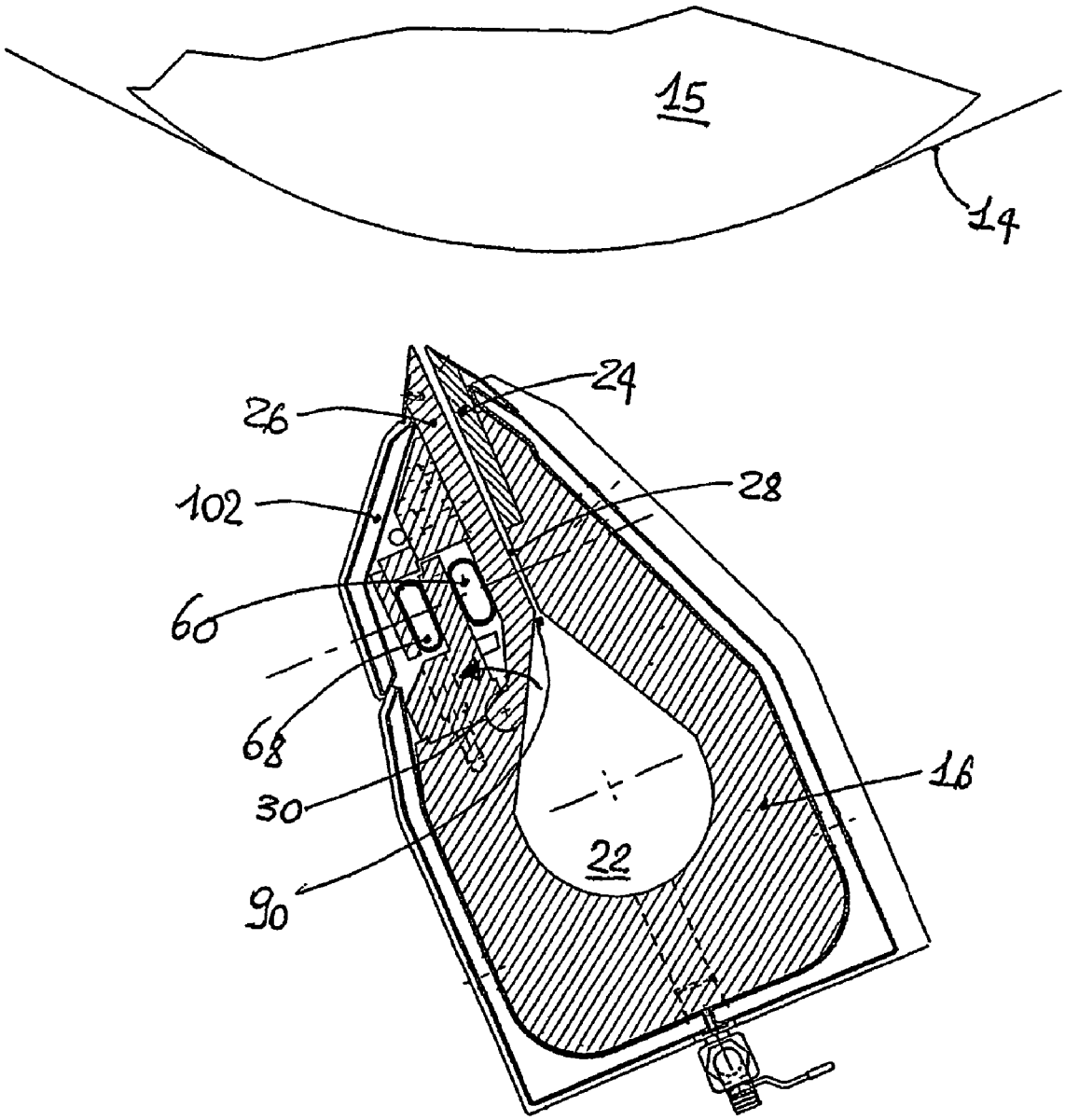
FIG. 3 is a similar view to that shown in FIG. 1 but shows the applicator in a flushing disposition.

FIG. 3 is a similar view to that shown in FIG. 1 but shows the applicator in a flushing disposition. As shown in FIG. 3, for flushing the apparatus, the fountain applicator 16 is displaced from the backing roll 15 and by releasing air pressure from a dosing tube 60 and feeding an opening tube 68 with air pressure, the slot 28 opens up to a second disposition for flushing. In the second disposition, an opening adequate to guarantee removal of all impurities in the whole slot 28 including a throat area 90 from the feeding chamber 22 to the slot 28 is achieved. The flushing or second disposition is attained by rotating the movable lip 26 in the direction of arrow 30.

Figure 4:
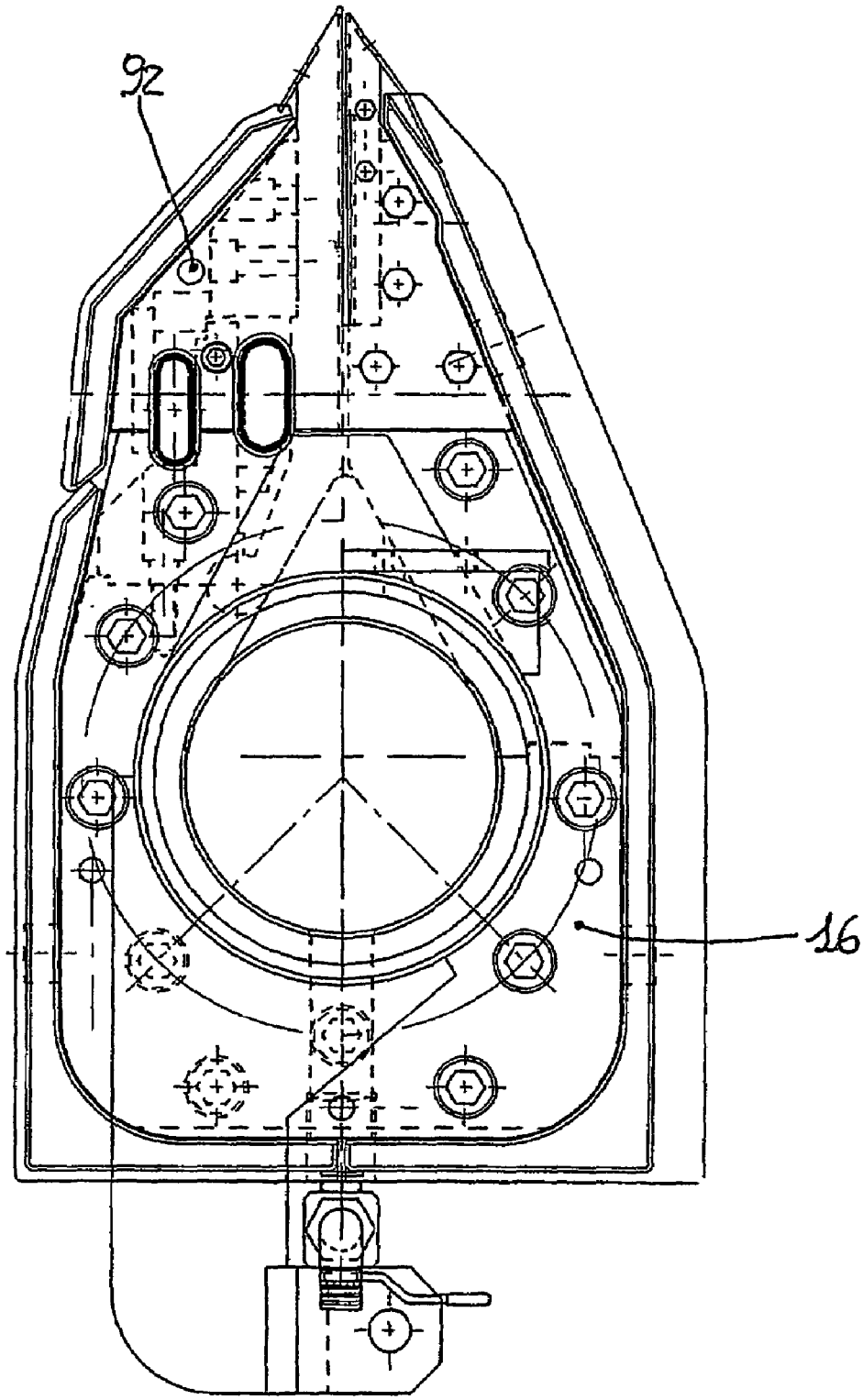
FIG. 4 is a view taken on the line 4—4 of FIG. 2.

FIG. 4 is a view taken on the line 4—4 of FIG. 2. As shown in FIG. 4, the slot 28 opening can be varied from the first disposition to the flushing second disposition by the rotation of the front and back pins 92 shown in FIG. 4. The pins 92 have an eccentric seat on the sides and are located in the front and backside 18 and 20 respectively of the applicator 16. More specifically, the rotation of the eccentric where the pins 92 are seated regulate the size or value of the opening. The rotation value of the eccentric pins 92 is indicated on the front and back side 18 and 20 of the applicator 16.

Figure 5:
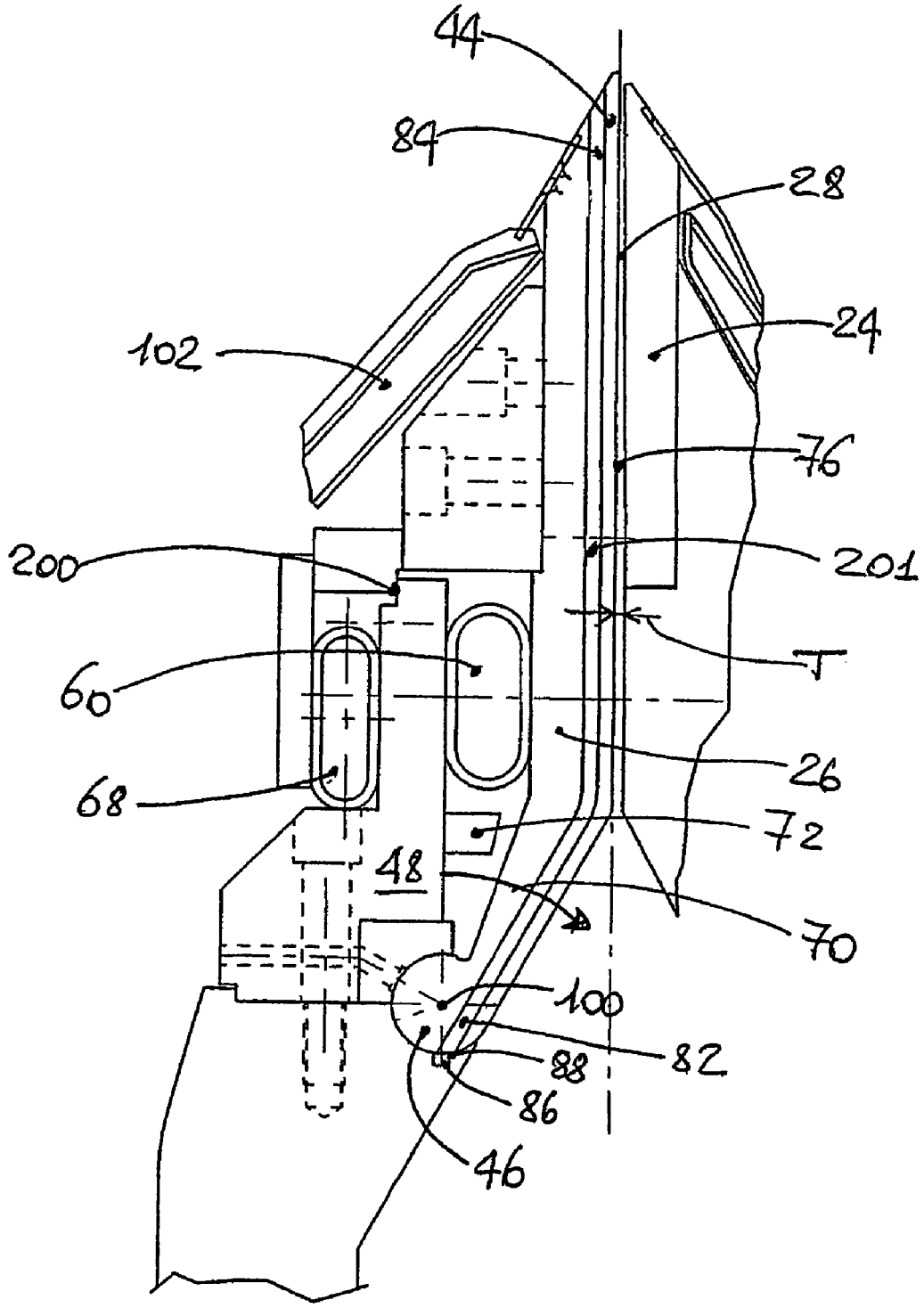
FIG. 5 is an enlarged fragmentary view of a portion of the applicator shown in FIG. 1.

FIG. 5 is an enlarged fragmentary view of a portion of the applicator 16. As shown in FIG. 5, an edge seal 201 is provided on the front side 18. The mentioned seals allow the movement of the movable lip with respect to the front and back sides and avoid coat to pass out of the slot.

FIG. 2 shows the seals 76 and 78 disposed adjacent to the front and backside 18 and 20 respectively of the applicator 16. The seals 76 and 78 are moved away from the slot 28 in order to maintain the slot 28 free for the flow of flushing fluid and at the same time to maintain the sealing at the front and backside 18 and 20 respectively.

When the flushing operation has been completed, the slot 28 is dosed by moving back the movable lip 26 to the first disposition delimited by mechanical stops 200 shown in FIG. 5, installed outside the flow area and all across the fountain applicator 16. Such dosing is achieved by releasing air pressure from the opening tube 68 and feeding the dosing tube 60 with pressurized air. The side seals 76 and 78 are then relocated into the working position shown in FIG. 5. With the slot 28 dosed, the applicator 16 is rotated back into the operating disposition.

Figure 6:
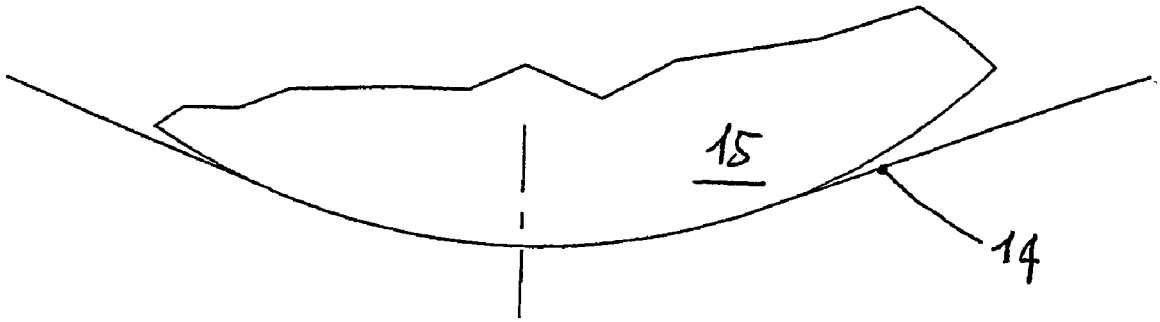
FIG. 6 is a similar view to that shown in FIG. 1 but shows the applicator in a third disposition thereof for cleaning and maintenance of the applicator.
Figure 6:
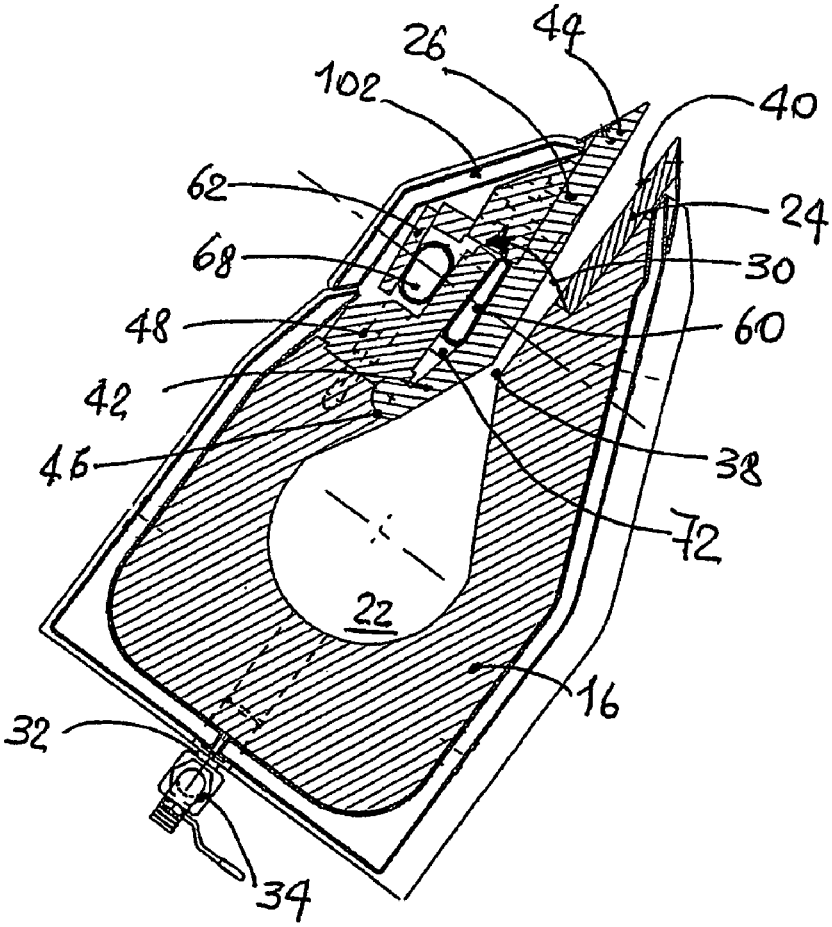

FIG. 6 is a similar view to that shown in FIG. 1. However, as shown in FIG. 6, when the movable lip 26 is pivoted away from the fixed lip 24 as indicated by the arrow 30 to a third disposition thereof as shown in FIG. 6, cleaning and maintenance of the applicator 16 is permitted.

As shown in FIG. 2, the applicator 16 extends across the width W of the web 14. Additionally, as shown in FIG. 2, the applicator 16 is pivotally mounted at 17 relative to the web 14 so that the applicator 16 can be pivoted away from the web 14 prior to commencing a flushing operation as shown in FIG. 3 or a cleaning and maintenance operation as shown in FIG. 6.

Furthermore, as shown in FIGS. 1 and 6, the feeding chamber 22 is connected by a transient pipe located on the front and backside of the fountain applicator to a pressurized source of the coating material (not shown). A recirculation line 32 is provided at the center of the fountain applicator through a port 34 having a valve to control the uniform liquid distribution. Also, as shown in FIGS. 1 and 6, the feeding chamber 22 is of pear shaped cross sectional configuration with the slot 28 extending from the apex 38 of the feeding chamber 22.

As shown in FIGS. 1 and 6, the fixed lip 24 defines a smooth wall 40 which extends from the feeding chamber 22 towards the web 14.

As shown in FIG. 6, the movable lip 26 has a first and a second end 42 and 44 respectively, the first end 42 of the movable lip 26 defining a knuckle 46.

Moreover, the coater apparatus 10 further includes a section 48. As shown in FIG. 2, the section 48 has a first and a second extremity 50 and 52 respectively. The section 48 extends between the first and second ends 18 and 20 of the applicator 16 such that the movable lip 26 is disposed between the slot 28 and the section 48 as shown in FIGS. 1 and 6.

Figure 7:
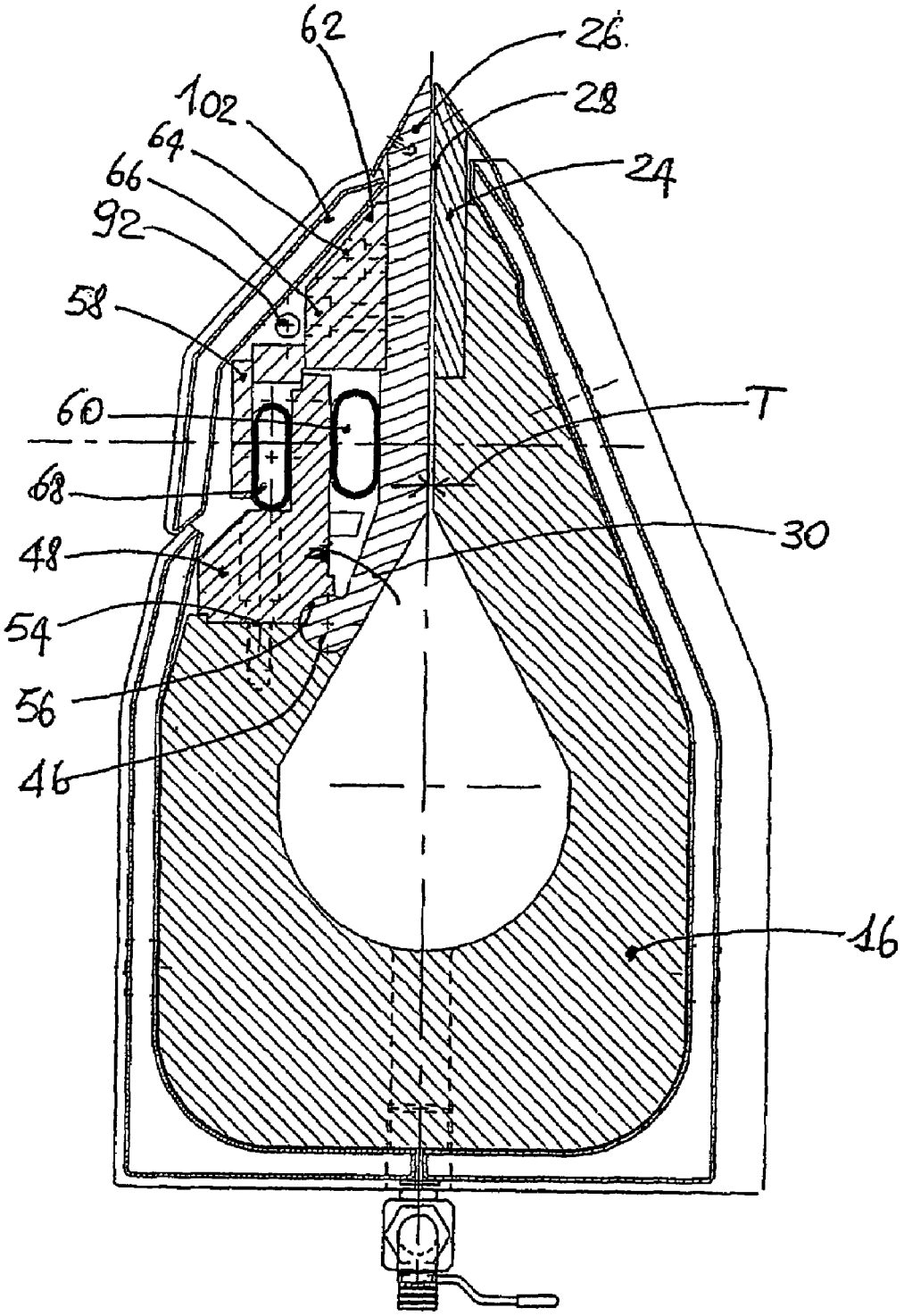
FIG. 7 is an enlarged view of the applicator shown in FIG. 1

FIG. 7 is an enlarged view of the applicator 16. As shown in FIG. 7, the section 48 is removably secured by bolts 54 to the applicator 16. The section 48 defines a socket 56 for the rotatable reception therein of the knuckle 46 of the movable lip 26 for permitting pivoting of the movable lip 26 away from the fixed lip 24 as indicated by the arrow 30.

A mechanism generally designated 58 is disposed adjacent to the section 48 for controlling movement as indicated by the arrow 30 of the movable lip 26 relative to the fixed lip 24.

More specifically, the mechanism 58 includes the inflatable tube 60 which extends between the first and second extremities 50 and 52 respectively of the section 48.

Also, the mechanism 58 further includes an elongate member generally designated 62 which is secured by threaded bolts 64 and 66 respectively to the movable lip 26. Those skilled in the art will appreciate that rows of bolts 64 and 66 are provided for securing the elongate member 62 along the length thereof to the movable lip 26.

As shown in FIG. 7, the further inflatable tube 68 is disposed between the elongate member 62 and the section 48 such that when the inflatable tube 60 is deflated as shown in FIG. 6 and the further inflatable tube 68 is inflated as also shown in FIG. 6, the elongate member 62 and the movable lip 26 secured thereto is urged by the further inflatable tube 68 away from the section 48. The arrangement is such that the movable lip 26 pivots away from the fixed lip 24 as indicated by the arrow 30 to the open third disposition thereof as shown in FIG. 6.

As shown in FIG. 5, when the further inflatable tube 68 is deflated and the inflatable tube 60 is inflated, the movable lip 26 is pivoted as indicated by the arrow 70 from the open third disposition shown in FIG. 6 to the dosed first disposition thereof as shown in FIGS. 1, 4, 5 and 7.

Additionally, as shown in FIG. 5, the section 48 includes a stop 72 for limiting pivotal movement of the movable lip 26 away from the fixed lip 24. As shown in FIG. 6, the movable lip 26 is shown abutting against the stop 72. Preferably, the stop 72 extends between the extremities 50 and 52 of the section 48.

Also, as particularly shown in FIG. 4 the elongate member 62 includes the rotatable seat pin 92 for adjusting how far the movable lip 26 is permitted to pivot away from the fixed lip 24 thus controlling a thickness T of the slot 28 for flushing purposes. As shown in FIG. 5, the slot 28 decreases in thickness T in a direction from the feeding chamber 22 towards the web 14 when in the first disposition.

As shown in FIG. 2, the coater apparatus 10 further includes the first and a second edge seals 76 and 78 respectively. The first seal 76 cooperates with the front 18 of the applicator 16 for sealing the feeding chamber 22 and the slot 28. The second seal 78 cooperates with the backside 20 of the applicator 16 for sealing the feeding chamber 22 and the slot 28. The seals 76 and 78 are movable away from the slot 28 in the flushing disposition and removable away from the slot 28 during a cleaning and maintenance operation of the apparatus 10.

As shown in FIG. 5, the movable lip 26 is provided with the sealing strip 201 which extends from the knuckle 46 to the second end 44 of the movable lip 26. The sealing strip 201 has a first and second termination 82 and 84 respectively. The first termination 82 of the sealing strip 201 cooperates with a transverse seal 86 which is located within a groove 88 which extends from the front 18 of the applicator 16 to the backside 20 of the applicator 16.

In operation of the apparatus according to the present invention, the liquid coating material 12 is supplied to the fountain applicator 16 with the slot 28 in the dosed first disposition as shown in FIG. 1. The slot opening is within the range 0.6 to 3 mm.

For flushing the applicator 16 can be rotated away from the backing roll 15 and moved into the second disposition where such flushing can be performed easily as shown in FIG. 3.

The pins 92 are removed from the front and backside 18 and 20 respectively for the cleaning and maintenance operation. The air pressure in the dosing tube 60 is released while the opening tube 68 is pressurized. Consequently, the slot 28 opens up to the third disposition and the maximum opening permits a complete cleaning with water or other mechanical means. The stops 72 are provided in order to limit outward movement of the movable lip 26. Before a complete cleaning operation is carried out, the edge seals 76 and 78 are removed from the applicator 16.

After completing the deep or complete cleaning operation, the movable lip 26, limiting one side of the slot 28, is moved to the dosed first disposition as shown in FIG. 1. A mechanical stop 200 as shown in FIG. 5 is provided outside the slot 28. The stop 200 extends for its entire width between the front and backsides 18 and 20 and determines the stroke or movement of the lip 26 to the dosed disposition. The edge seals 76 and 78 are located prior to moving the lip 26 to the dosed disposition. Also, the pins 92 are reinserted into the operating position. The fountain applicator 16 is then ready to return to the working position as shown in FIG. 1.

During both the flushing and cleaning operation, the movable lip 26 rotates around a fixed point 100 shown in FIG. 5, determined by a mechanical damp which is the section 48. The section 48 is uniform all across in a cross machine direction thus guaranteeing a uniform rotation of the movable lip 26.

Suitable seal and greasing systems are provided for enabling rotation of the movable lip 26 so as to provide a seal with the front and back sides of the applicator 16.

Additionally, complete thermal sealing is guaranteed by the provision of thermal seals 102.

The apparatus according to the present invention provides a unique arrangement for permitting both flushing and cleaning of a fountain coater.

It win be appreciated that the foregoing is merely exemplary of coater apparatus in accordance with the invention and that modifications can readily be made thereto without departing from the true scope of the invention as set out in the appended claims.

What is claimed is:

1. A coater apparatus for applying coating material onto a moving web, said apparatus comprising:

an applicator having a front and a back side, said applicator defining a feeding chamber for the reception therein of the coating material;

said applicator including:

a fixed lip extending from said feeding chamber towards the web;

a movable lip extending from said feeding chamber such that when said movable lip is disposed in a first disposition thereof, said movable lip cooperates with said fixed lip for defining therebetween a slot for guiding the coating material from said feeding chamber towards the moving web and when said movable lip is pivoted away from said fixed lip to a second disposition thereof, flushing of said applicator is permitted and when said movable lip is further pivoted away from said fixed lip to a third disposition thereof, cleaning and maintenance of said applicator is permitted;

said movable lip having a first and a second end, said first end of said movable lip defining a knuckle;

a section having a first and a second extremity, said section extending between said first and second ends of said applicator such that said movable lip is disposed between said slot and said section; and said section being removably secured to said applicator, said section defining a socket for the rotatable reception therein of said knuckle of said movable lip for permitting pivoting of said movable lip away from said fixed lip.

2. A coater apparatus as set forth in claim 1 wherein said applicator extends across the width of the web.

3. A coater apparatus as set forth in claim 1 wherein said applicator is pivotally mounted relative to the web.

4. A coater apparatus as set forth in claim 1 wherein said feeding chamber is connected to a pressurized source of the coating material.

5. A coater apparatus as set forth in claim 1 wherein said feeding chamber is of pear shaped cross-sectional configuration.

6. A coater apparatus as set forth in claim 1 wherein said fixed lip defines a smooth wall which extends from said feeding chamber towards the web.

7. A coater apparatus as set forth in claim 1 further including:

a mechanism disposed adjacent to said section for controlling movement of said movable lip relative to said fixed lip.

8. A coater apparatus as set forth in claim 7 wherein said mechanism includes:

an inflatable tube which extends between said first and second extremities of said section, said inflatable tube being disposed between said section and said movable lip.

9. A coater apparatus as set forth in claim 8 wherein said mechanism further includes:

an elongate member secured to said movable lip;

a further inflatable tube disposed between said elongate member and said section such that when said inflatable tube is deflated and said further inflatable tube is inflated, said elongate member and said movable lip secured thereto is urged by said further inflatable tube away from said section so that said movable lip pivots away from said fixed lip to said second or third disposition thereof and when said further inflatable tube is deflated and said inflatable tube is inflated, said movable lip is pivoted from said second or third disposition to said first disposition thereof.

10. A coater apparatus as set forth in claim 9 wherein said elongate member further includes:

a rotatable pin having a seat on a side with the shape of an eccentric for adjusting how far said movable lip pivots towards said fixed lip thus controlling a thickness of said slot.

11. A coater apparatus for applying coating material onto a moving web, said apparatus comprising:

an applicator having a front and a back side, said applicator defining a feeding chamber for the reception therein of the coating material;

a fixed lip extending from said feeding chamber towards the web;

a movable lip having a first and a second end, said movable lip extending along and from said feeding chamber such that when said movable lip is disposed in a first disposition thereof, said movable lip cooperates with said fixed lip for defining therebetween a slot for guiding the coating material from said feeding chamber towards the moving web and when said movable lip is pivoted away from said fixed lip to a second disposition thereof, flushing of said applicator is permitted and when said movable lip is further pivoted away from said fixed lip to a third disposition thereof, cleaning and maintenance of said applicator is permitted;

a knuckle defined by said first end of said movable lip such that said knuckle is pivotally secured to said applicator, said knuckle being spaced laterally from said feeding chamber;

said movable lip defining said feeding chamber when said movable lip is disposed in said first, second and third dispositions thereof so that flow of coating material from said coating chamber is permitted in said first second and third dispositions;

a section having a first and a second extremity, said section extending between said first and second ends of said applicator such that said movable lip is disposed between said slot and said section; and said section including:

a stop for limiting pivotal movement of said movable lip away from said fixed lip.

12. A coater apparatus as set forth in claim 11 wherein said stop extends between said extremities of said section.

13. A coater apparatus for applying coating material onto a moving web, said apparatus comprising:

an applicator having a front and a back side, said applicator defining a feeding chamber for the reception therein of the coating material;

a fixed lip extending from said feeding chamber towards the web;

a movable lip having a first and a second end, said movable lip extending along and from said feeding chamber such that when said movable lip is disposed in a first disposition thereof, said movable lip cooperates with said fixed lip for defining therebetween a slot for guiding the coating material from said feeding chamber towards the moving web and when said movable lip is pivoted away from said fixed lip to a second disposition thereof, flushing of said applicator is permitted and when said movable lip is further pivoted away from said fixed lip to a third disposition thereof, cleaning and maintenance of said applicator is permitted;

a knuckle defined by said first end of said movable lip such that said knuckle is pivotally secured to said applicator, said knuckle being spaced laterally from said feeding chamber;

said movable lip defining said feeding chamber when said movable lip is disposed in said first, second and third dispositions thereof so that flow of coating material from said coating chamber is permitted in said first second and third dispositions; and a first and a second edge seal, said first seal cooperating with said front of said applicator for sealing said feeding chamber and said slot, said second seal cooperating with said backside of said applicator for sealing said feeding chamber and said slot, said seals being movable away from said feeding chamber and slot during a flushing operation, said seals being removable during a cleaning operation of said apparatus.

14. A coater apparatus for applying coating material onto a moving web, said apparatus comprising:

an applicator having a first and a second end, said applicator defining a feeding chamber for the reception therein of the coating material;

said applicator including:

a fixed lip extending from said feeding chamber towards the web;

a movable lip extending from said feeding chamber such that when said movable lip is disposed in a first disposition thereof, said movable lip cooperates with said fixed lip for defining therebetween a slot for guiding the coating material from said feeding chamber towards the moving web and when said movable lip is pivoted away from said fixed lip to a second disposition thereof, flushing of said applicator is permitted and when said movable lip is further pivoted away from said fixed lip to a third disposition thereof, cleaning and maintenance of said applicator is permitted;

said applicator extending across the width of the web and being pivotally mounted relative to the web;

said feeding chamber being connected to a pressurized source of the coating material;

said fixed lip defining a smooth wall which extends from said feeding chamber towards the web;

said movable lip having a first and a second end, said first end of said movable lip defining a knuckle;

a section having a first and a second extremity, said section extending between said first and second ends of said applicator such that said movable lip is disposed between said slot and said section;

said section being removably secured to said applicator, said section defining a socket for the rotatable reception therein of said knuckle of said movable lip for permitting pivoting of said movable lip away from said fixed lip;

a mechanism disposed adjacent to said section for controlling movement of said movable lip relative to said fixed lip;

said mechanism including:

an inflatable tube which extends between said first and second extremities of said section, said inflatable tube being disposed between said section and said movable lip;

said mechanism further including:

an elongate member secured to said movable lip;

a further inflatable tube disposed between said elongate member and said section such that when said inflatable tube is deflated and said further inflatable tube is inflated, said elongate member and said movable lip secured thereto is urged by said further inflatable tube away from said section so that said movable lip pivots away from said fixed lip to said second or third disposition thereof and when said further inflatable tube is deflated and said inflatable tube is inflated, said movable lip is pivoted from said second or third disposition to said first disposition thereof; said section including:

a stop for limiting pivotal movement of said movable lip away from said fixed lip; and said stop extending between said extremities of said section.

* * * * *

UNITED STATES PATENT AND TRADEMARK OFFICE

CERTIFICATE OF CORRECTION

PATENT NO. : 7,169,230 B2
APPLICATION NO. : 10/503883
DATED : January 30, 2007
INVENTOR(S) : Luca Ghelli, Corrado Turinetti and Giorgio Baldini It is certified that error appears in the above-identified patent and that said Letters Patent is hereby corrected as shown below:

On the title page item (75), line 2, Inventor: Giorgio --Baldini-- not "Baldins"
Column 1, line 37 --closing-- not "dosing"
Column 5, line 32 --closing-- not "dosing"
Column 5, line 33 --closing-- not "dosing"
Column 5, line 36 --closing-- not "dosing"
Column 7, line 15 --closing-- not "dosing"
Column 7, line 7 --closed-- not "dosed"
Column 7, line 25 --closed-- not "dosed"
Column 7, line 29 --closed-- not "dosed"
Column 7, line 31 --closed-- not "dosed"
Column 7, line 36 --clamp-- not "damp"

Signed and Sealed this

Seventeenth Day of April, 2007

JON W. DUDAS
*Director of the United States Patent and Trademark Office*